United States Patent [19]

Murray

[11] 4,402,489

[45] Sep. 6, 1983

[54] ROPE PROTECTION DEVICE

[76] Inventor: Richard C. Murray, 402 Lincoln Ave., Staten Island, N.Y. 10306

[21] Appl. No.: 229,544

[22] Filed: Jan. 29, 1981

[51] Int. Cl.[3] ..... B65H 57/04; B65H 57/12

[52] U.S. Cl. ..... 254/389; 182/230; 242/157 R; 410/99; 410/41

[58] Field of Search ..... 254/189; 242/157 R; 294/131, 74, 151; 410/99, 41, 155; 182/5, 230; 428/61, 101, 116, 47, 48

[56] References Cited

U.S. PATENT DOCUMENTS 1,933,751 11/1933 Nelson ..... 254/389

3,378,889 4/1968 Dunderdale ..... 410/99

3,668,049 6/1972 Silfverlin ..... 428/47

4,011,632 3/1977 MacDonald ..... 410/99

*Primary Examiner*—Billy S. Taylor

[57] ABSTRACT

A rope protection device comprising several layers of canvass with spaced splints lodged between bottom and adjacent layers of canvass, said layers being joined at the periphery by sewing or the like wherein opposite edges of the canvass assembly are folded over towards each other to provide a channel for a rope therein including transverse spaced webbing binding the opposite edges of the assembly in a fixed channel forming position wherein the rope can be threaded through the opposite open ends of the device.

1 Claim, 4 Drawing Figures

ROPE PROTECTION DEVICE

BACKGROUND OF THE INVENTION

1. Field of the Invention

This invention concerns the protection from abraision or cutting of the fibers of rope and/or life line where the rope or line is deployed over sharp edges or rough surfaces.

2. Description of Present Protective Measures

Rope used in the fields of firefighting, mountain climbing, cave exploring, rigging, window washing, etc. are often deployed over rough or jaggered surfaces. As the rope is played out over these damaging areas, cottom blankets, rubber lined hose, wood rollers and other various materials are placed over the surface to protect the fibers. In order that these devices protect rope in all its various usage, a method of securing the device is necessary. Some of the protective devices are subject to damage from the rope as it passes over the device and the device must be replaced. If a presently used device is not secured during use it will be pulled in the direction in which the rope is being deployed due to friction and the damaging surface will become exposed to the rope. It is therefore necessary to have available a protective device that is compatible to all areas of rope usage without the necessity of having to secure the device. A protective device must also provide long wear and dependable protection for the safety of the people who use rope in the above mentioned fields.

SUMMARY OF THE INVENTION

In the following specification and claims it will become apparent this device is compatible to various rope or life line usage. Its purpose is to protect the rope fibers where they may become damaged or cut, such as the rope being deployed from any elevated cliff, crag, sill or parapet. The design of the device is such, so as to reduce friction to the smallest degree from the effect of the passage of rope. An internal core of hard material such as wood, rubber, metal or plastic, encased in a canvas, cotton or similar material, separates the rope from sharp or rough surfaces or edges.

DETAILED DESCRIPTION

It is to be understood that the terminology of the particular embodiment are not intended to limit the invention to the specific recitations inasmuch as the invention is susceptible of some variation within the scope.

Figure 1:
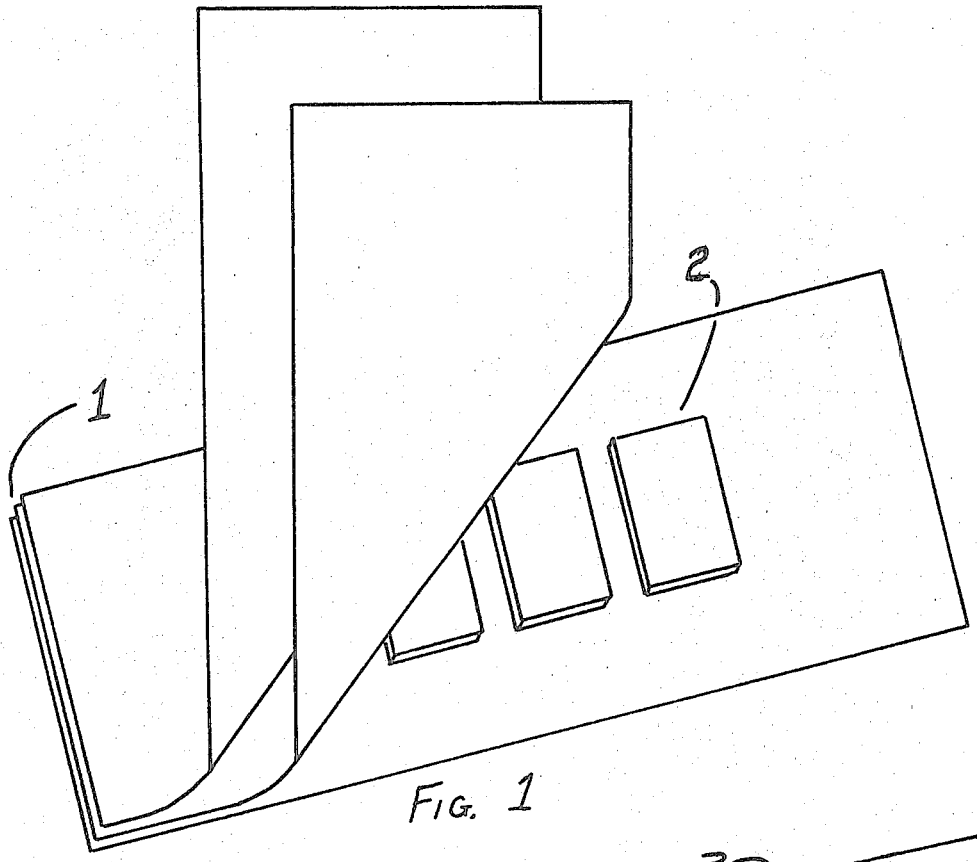
FIG. 1 is a view of the encasing material and the position and placement of the reinforcement material.
Figure 2:
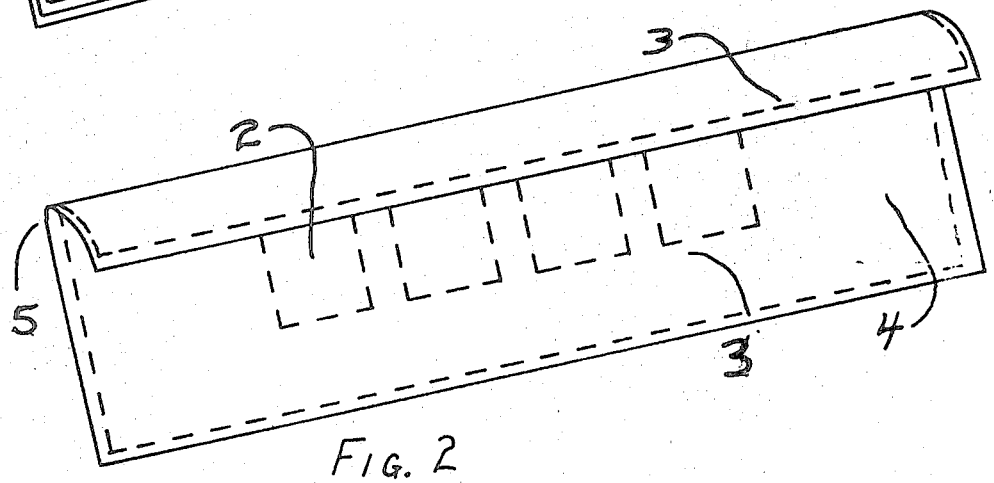
FIG. 2 is a view of the reinforcement and casing materials properly positioned and sewn together and being formed.

The device for the protection of rope includes three sheets of canvas measuring 9″×24″, placed and evenly layered on a flat surface 1 (FIG. 1). Four splints 2 measuring $2\frac{1}{2}''\times4''\times\frac{3}{8}''$ are placed between the bottom and middle layers to provide reinforcement of the device.

The three sheets of canvas are sewn together around each splint and along all outer edges 3. Each splint is positioned $\frac{3}{4}''$ apart to define a hinged area with an allowance of 6″ of unreinforced material at each end 4 and $2\frac{1}{2}''$ of unreinforced material along each side. A fold 5 is made along each longitudinal side to provide a channel with sides curved toward each other in spaced apart relationship for a rope to traverse.

Figure 3:
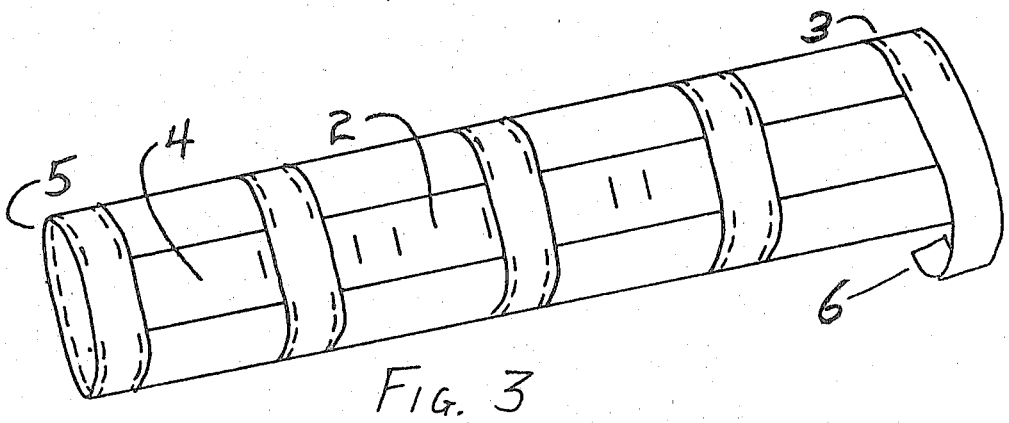
FIG. 3 is a view of webbing strips as they are attached to maintain the form of the device.

Five strips of webbing 6 (FIG. 3) measuring $1\frac{1}{2}''\times11''$ are attached equally spaced to the outer circumference of the formed canvas with the thread being sewn along the edges of the webbing 3.

Figure 4:
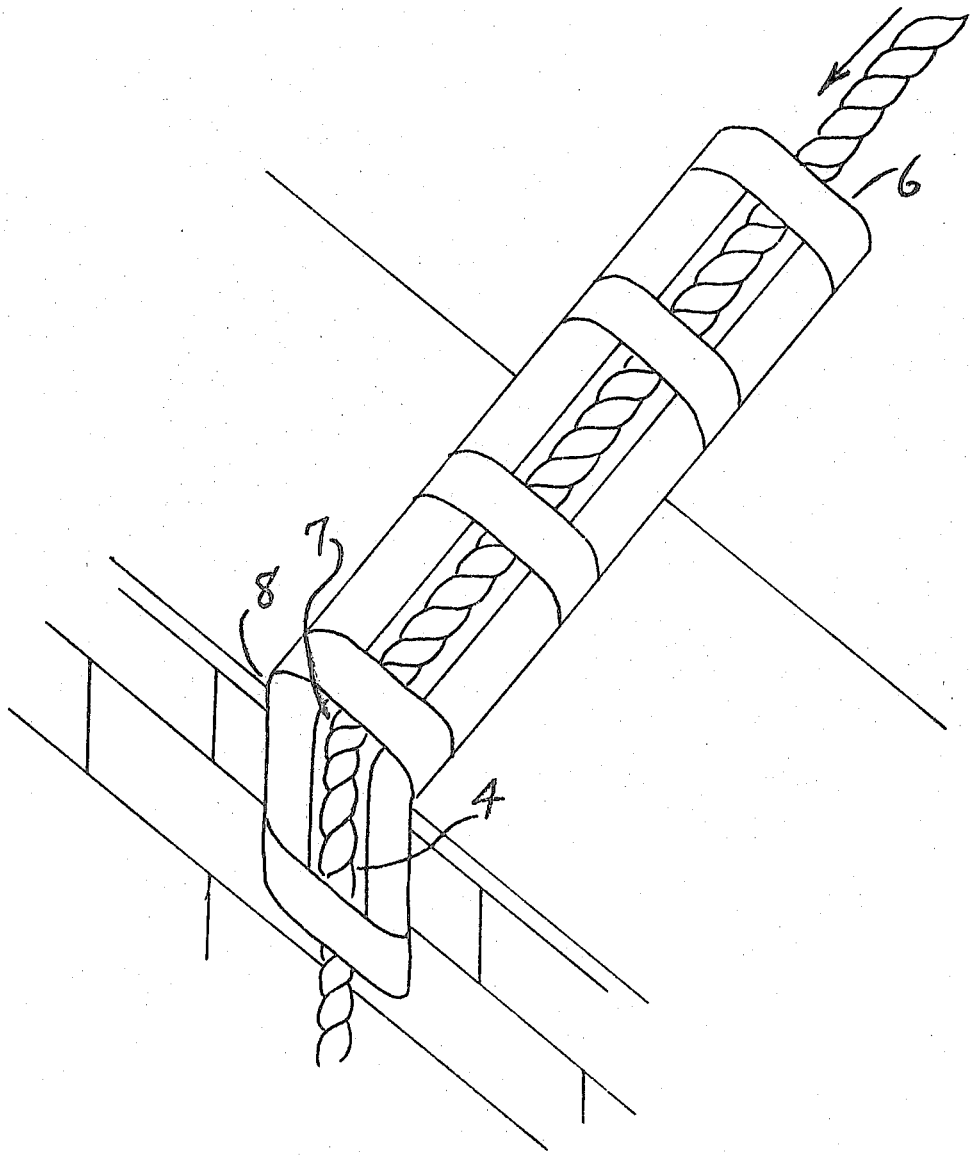
FIG. 4 is a perspective view of the device constructed and as it would be used.

The webbing 6 maintains the tubular shape of the device and provides a guide for the rope 7 (FIG. 4). The device is properly positioned with the opened side facing up and the unreinforced portion of one end 4 is placed where the rope 7 will descend over a sharp bend such as a roof parapet 8.

I claim:

1. An elongated rope protection device comprising; a flexible channel formed from multiple fabric layers having longitudinal sides curved toward each other with strap means maintaining the sides in spaced apart relationship to define a tube with opened ends adapted to receive and secure a rope therethrough; a plurality of substantially rigid splints spaced apart within the fabric layers, means attaching said splints in predetermined spaced locations along the length of the device to define therebetween hinged areas.

* * * * *